US012703947B2

(12) United States Patent
Hietala et al.

(10) Patent No.: US 12,703,947 B2
(45) Date of Patent: Aug. 11, 2026

(54) BIOPOLYMER COMPOSITION AND ITS USE AS A POWDER COATING

(71) Applicant: Brightplus Oy, Oulu (FI)

(72) Inventors: Maiju Hietala, Oulu (FI); Rauna-Leena Kuvaja, Oulu (FI); Admir Hadzic, Oulu (FI); Tuire Marin, Oulu (FI); Jarkko Leivo, Oulu (FI)

(73) Assignee: Brightplus Oy, Oulu (FI)

( * ) Notice: Subject to any disclaimer, the term of this patent is extended or adjusted under 35 U.S.C. 154(b) by 1022 days.

(21) Appl. No.: 17/785,965

(22) PCT Filed: Jan. 21, 2021

(86) PCT No.: PCT/FI2021/050036

§ 371 (c)(1),
(2) Date: Jun. 16, 2022

(87) PCT Pub. No.: WO2021/148719

PCT Pub. Date: Jul. 29, 2021

(65) Prior Publication Data

US 2023/0357991 A1 Nov. 9, 2023

(30) Foreign Application Priority Data

Jan. 21, 2020 (EP) ..... 20397501

(51) Int. Cl.

| | |
|---|---|
| ***D21H 19/32*** | (2006.01) |
| ***D21H 19/72*** | (2006.01) |
| ***D21H 23/50*** | (2006.01) |
| ***D21H 25/04*** | (2006.01) |
| ***D21H 27/10*** | (2006.01) |

(52) U.S. Cl.
CPC ..... *D21H 19/32* (2013.01); *D21H 19/72* (2013.01); *D21H 23/50* (2013.01); *D21H 25/04* (2013.01); *D21H 27/10* (2013.01)

(58) Field of Classification Search
CPC ..... D21H 19/32; D21H 17/13; D21H 19/72; D21H 27/10; Y02W 90/10
See application file for complete search history.

(56) References Cited

U.S. PATENT DOCUMENTS

| | | | | |
|---|---|---|---|---|
| 5,227,435 | A | 7/1993 | Kang et al. | |
| 6,274,672 | B1 | 8/2001 | Ambrose et al. | |
| 2004/0058166 | A1* | 3/2004 | Nakamura | D21H 23/64 427/195 |

FOREIGN PATENT DOCUMENTS

| | | | | | |
|---|---|---|---|---|---|
| AU | 3265171 | A | | 3/1973 | |
| CN | 1826222 | A | | 8/2006 | |
| CN | 1902262 | A | | 1/2007 | |
| CN | 102414257 | A | | 4/2012 | |
| CN | 109069399 | A | | 12/2018 | |
| JP | 2000319374 | A | | 11/2000 | |
| JP | 2001303478 | A | | 10/2001 | |
| JP | 2003013391 | A | | 1/2003 | |
| JP | 2006104227 | A | | 4/2006 | |
| JP | 2010280156 | A | | 12/2010 | |
| JP | 2011195817 | A | | 10/2011 | |
| JP | 2012515835 | A | | 7/2012 | |
| JP | 2014051095 | A | * | 3/2014 | B29C 48/92 |
| JP | 2014517850 | A | | 7/2014 | |
| WO | WO2010037906 | A1 | | 4/2010 | |
| WO | WO2012137014 | A1 | | 10/2012 | |

OTHER PUBLICATIONS

English translation of JP 2014051095 A retrieved from espacenet (Year: 2025).*

Nagata et al: Synthesis and Characterization of PLLA/Silica Hybrid. Polymer Preprints, 2009, vol. 58, No. 2, p. 3410.

* cited by examiner

*Primary Examiner* — Abbas Rashid
*Assistant Examiner* — Elisa H Vera
(74) *Attorney, Agent, or Firm* — Thomas Ohman; Laine IP Oy

(57) ABSTRACT

The present invention concerns a packaging material having a coating made of a biopolymer composition. In addition, the invention concerns a method for providing barrier properties for a packaging material by using the above mention composition. In particular, the present invention concerns coating of a porous material with a composition comprising a biopolymer formed by the reaction product of biodegradable polyester and siloxane precursor.

20 Claims, No Drawings

BIOPOLYMER COMPOSITION AND ITS USE AS A POWDER COATING

BACKGROUND OF THE INVENTION

The present invention concerns a biopolymer composition suitable to be used as a coating for porous substrates, thus forming a packaging material. The invention also concerns a method for providing barrier properties for a packaging material by coating.

DESCRIPTION OF RELATED ART

Barrier properties are required in many applications, especially in packaging applications, such as in packaging materials for foodstuffs, cosmetics, drugs and a like. Proper barrier properties protect the product inside the package from light, oxygen, and moisture, preventing contamination. Furthermore, undesirable leaching of the product to the outside of the package is prevented with barrier properties.

Food packaging materials made from paper or cardboard typically have a polymeric coating layer to improve its barrier properties and to protect the product. Most typically this coating layer is made of fossil-based thermoplastics, such as polyethylene. Polyethylene has many desired properties, such as flexibility and heat-sealability but it has the drawback of not being biodegradable or compostable.

Use of biopolymers is an attractive option to replace these plastic coatings, and thus biodegradable multilayer laminate films have been developed for coating of different packaging materials. Materials, such as metals, e.g., aluminium or tinplate, glass, polymers, e.g., PP, PE, PET or PVDC, and polymers provided with vaporized thin metallic or oxide films or combinations thereof are generally employed as components for these structures. These known multilayer films can be bio-based or partially bio-based and they can be biodegradable or non-biodegradable. The use of renewable resources and biodegradability can solve some problems; however, lamination process produces a lot of waste material making it a less sustainable method. In addition, the multi-layer structures are very problematic from recycling point of view, when it is important to be able to identify and separate the used polymeric grades. Also, there is still room for improvements in barrier properties of packaging material coatings.

There have been attempts to find alternative methods for laminated films. One of the coating methods used is powder coating which is a method in which the coating material is in the form of solid, fine particles (powder), whereby there is no need for a solvent to carry the coating material on the substrate to be coated. Such process emits less volatile organic compounds (VOCs). Typically, the powder coating materials are thermoset or thermoplastic powders that are applied using various powder coating technologies on the substrate, after which the coating is cured, and the product is cooled to solidify the coating.

There are also some patents presenting powder coating compositions which are able to form thin water-resistant coatings on metal or glass substrates. Publication U.S. Pat. No. 6,274,672 presents a powder coating composition containing functional polysiloxanes. The powder coating composition comprises solid particulate film-forming mixture of polymer containing reactive functional groups, curing agents and organic polysiloxane. Publication U.S. Pat. No. 5,227,435 discloses a process for preparing silicone modified polyester resin and a powder coating composition containing the same. The process comprises condensation of silicone compounds with alcohols, reacting the thus prepared resins with acidic compounds in the presence of esterification catalyst, and finally reacting the thus prepared resins with trimellitic anhydride, whereby a polyester resin having low melting viscosity, low softening point and excellent storage stability is obtained.

Compared to metals and glass, advantages of polymers include their low weight and the small amount of material required. Also, especially due to ecological concerns, the importance of bio-based recyclable polymers is increasing significantly. However, due to their structure and permeability to gases and moisture polymers cannot meet very high barrier property requirements needed in some applications for example in high humidity and high temperature conditions. This is especially true for bio-based recyclable polymers.

SUMMARY OF THE INVENTION

The present invention aims at solving at least some of the problems of the prior art.

It is an object of the present invention to produce new kinds of packaging materials with a biopolymer coating composition, which packaging materials are adequate especially for packaging of food, cosmetics etc.

Thus, according to the first aspect the present invention relates to a coating composition, especially to a powder coating composition, comprising a biopolymer formed by the reaction product of biodegradable polyester and siloxane precursor.

According to the second aspect, the present invention relates to a packaging material comprising a porous substrate that has been coated with the above-described biopolymer composition.

According to the third aspect, the present invention relates to a method for producing a packaging material by coating a porous substrate with the above-described biopolymer composition.

Thus, the present invention is based on the idea of utilizing a pulverized thermoplastic biodegradable polymeric composition as a thin, flexible and biodegradable coating layer on a porous substrate. The biopolymer powder composition of the present invention is obtained by reacting polyester, preferably biodegradable polyester, and siloxane precursor with each other. The biopolymer thus obtained is pulverized to form a powder, which is applied onto the substrate and cured.

The powder coating composition of the present invention, combining biodegradable polyester with siloxane precursor(s), enables formation of a thin and flexible coating layer, preferably with barrier properties especially towards water vapour and oxygen. The siloxane precursor provides improved barrier properties to the composition and facilities levelling of the coating on the surface of the substrate, whereby a better surface quality is obtained.

The coating layer formed by the powder composition of the present invention can be a single-layer or a multi-layer coating. In one embodiment, the powder composition of the present invention provides single-layer coatings with good barrier properties. Single-layer coatings are thinner than multi-layer coatings, thus requiring less raw-material to form a uniform coating, thereby being more economical and ecological. Thinner coating layers also confer improved flexibility of the coating.

In particular, the present invention is characterized by what is stated in the independent claims. Some specific embodiments are defined in the dependent claims.

Several advantages are reached using the present invention. Among others, the invention provides a packaging material with a coating composition having good barrier properties combined with biodegradability and/or recyclability. Thus, the invention solves at least some of the problems of polymer structures suffering from permeability to gases and moisture, since the siloxane precursor confers improved barrier properties to the composition. In addition, since the material is suitable for use as a single-layer coating, multi-layer structures are not required. Especially, the present invention provides a good coating composition for porous or otherwise liquid and/or gas permeable substrates to be used as packaging materials.

The material composition of the present invention is suitable to be used as a relatively thin coating layer for both rigid and flexible substrates. By applying the composition of the present invention on bio-based, biodegradable, recyclable and/or compostable substrates, the present invention ensures the recyclability of the entire package in accordance with the requirements of circular economy.

In addition, relatively low temperatures, such as temperatures in the range of 20 to 150° C., can be used in the coating of the substrate with the powder composition of the present invention, wherein the present invention is especially suitable for paper and cardboard type substrates. Low temperatures enable the avoidance of darkening and/or yellowing of the substrate.

Next, embodiments will be discussed in more detail.

EMBODIMENTS

The term "liquid state" in the present context also comprises a solution. Thus, according to the present invention, material is in a liquid state if it is a liquid as such, a melt achieved by heating the material above its melting temperature or dissolved, or at least dispersed, in a medium, preferably in a solvent.

"Room temperature" stands for a temperature of about 15 to 30° C., in particular 15 to 25° C., for example about 23° C.

As used herein, the term "about" refers to a value which is ±5% of the stated value. As used herein, the term "about" refers to the actual given value, and to an approximation to such given value that would reasonably be inferred to one of ordinary skill in the art, including approximations due to the experimental and/or measurement conditions for such given value.

Unless otherwise stated, the term "molecular weight" or "average molecular weight" refers to number average molecular weight (also abbreviated "$M_n$"). If not stated otherwise, the number average molecular weight is measured by GPC (Gel permeation chromatography), against a polystyrene standard in the context of the present invention.

Below, the term "siloxane precursor solution" is used in general to describe the liquid state of the siloxane precursor. In these contexts, the term solution comprises all kinds of liquid states described above.

In the present context, the term "biodegradable", when used in connection of a material, such as polyester, a biopolymer composition or a coating composition, and applied in particular to the organic part thereof, has the conventional meaning of the material being capable of degrading (breaking down) by the action of microorganisms, such as bacteria or fungi or both. Degradation can proceed through aerobic and anaerobic processes and will at the end typically yield carbon dioxide of the organic material. Biodegradation generally takes place in the present of water. Biodegrading the organic matter can be influenced by temperature and pH of the ambient and can take from days to months to even years to completion.

The present invention concerns a packaging material which is obtained by coating a porous substrate with a powder composition comprising a biopolymer formed by the reaction product of biodegradable polyester and siloxane precursor.

In one embodiment, the present packaging material comprises a coated porous substrate, wherein the porous substrate is coated with a molten layer comprising, or consisting of, or consisting essentially of a biopolymer formed by the reaction product of one or several biodegradable polyesters and one or several siloxane precursors.

In one embodiment, the coating of the porous substrate is obtained by melting of a powder coating composition applied onto the surface of the porous substrate.

In one embodiment, the coating is formed by a single layer.

In one embodiment, the coating provides the packaging material with barrier properties, in particular the coating provides barrier properties selected from the group of liquid barrier, gas barrier, oil barrier, grease barrier and combinations thereof.

According to a preferred embodiment, the powder composition provides barrier properties for the packaging material, especially barrier against water vapor and oxygen.

The biopolymer comprised in the powder composition is preferably a biodegradable, thermoplastic biopolymer having a monophasic structure. The term "monophasic" in the present invention stands for a material of uniform composition throughout that cannot be mechanically separated into different materials. The formed monophasic biopolymer is based on the interactions, i.e. chemical bonds, such as covalent bonds, between the polyester and the siloxane and the biopolymers formed.

The substrate to be coated can be any porous material. According to the present invention the term "porous" relates to a material that is permeable to gas, liquid, oils or fats or combinations thereof. Typically, the porous material is provided in the form of a sheet, board, plate, or web.

Examples of porous materials for use in embodiments of the present technology include paper and cardboard. In one embodiment, the porous materials comprise fibrous materials, typically in the form of sheets, boards, plates, or webs.

According to a preferred embodiment the substrate is a bio-based, biodegradable, recyclable, repulpable and/or compostable material.

"Bio-based substrates" are materials generally obtained from biological materials, such as biomass (e.g. carbohydrate materials, lignocellulosic materials, in particular in the form of fibrous materials), proteinaceous materials, and lipid-containing materials and combinations thereof. Typically, such materials can be biodegradable, recyclable, repulpable and/or compostable.

Thus, in one embodiment, the porous material comprises natural fibers, such as lignocellulosic or cellulosic fibers or combinations thereof.

In a preferred embodiment, the porous material or substrate is a bio-based substrate, including fibrous sheets, webs or objects, in particular sheets or webs of cellulosic or lignocellulosic materials, such as papers and paperboards.

Thus, in one embodiment, the substrate comprises 50 to 100% by weight, in particular 75 to 100% of natural fibers, such as cellulosic or lignocellulosic fibers or combinations thereof, calculated from the total weight of fibrous matter in the substrate.

In one embodiment, the porous material comprises a combination of natural and man-made fibers, such as a non-woven material. Examples of man-made fibers include regenerated fibers, such as fibers made by the viscose process, or Lyocell process or other synthetic fibers comprising materials derived from polysaccharides. Typically, the non-woven material comprises 10 to 75% by weight of natural fibers and 90 to 25% by weight of natural fibers. In addition, the non-woven material typically contains at least one binder, e.g. a synthetic binder, such as a latex.

In one embodiment, the porous material comprises plastic, i.e. thermoplastic, materials.

In one embodiment, the porous material comprises biopolymers, in particular thermoplastic polymers (for example polyesters), such as polylactic acid, polylactide, polyglycolide, polycaprolactone, polybutylene adipate terephthalate, polyhydroxyalkanoates, such as polyhydroxybutyrate, as well as copolymers of the monomers forming one or several of the foregoing polymers.

In one embodiment, the porous material comprises additional components selected from fillers, pigments, sizes, processing aids and reinforcing material and combinations thereof. Typically, the content of additional components is 1 to 75%, in particular 2 to 50%, of the total weight of the porous material.

In one embodiment, the porous material comprises fillers capable of rendering the porous material at least some barrier properties. Examples of such fillers include clay, nanoclay, geopolymer, cellulose, nanocellulose and talc.

In one embodiment, the porous material, in particular web or sheet or non-woven material, comprises reinforcing fibers, such as carbon or glass fibers or combinations thereof.

Typically, the content of such fibers is 0.1 to 50% by weight, in particular 1 to 20% by weight.

The porous materials can be obtained by, for example, sheet or web forming, for example by wet-laid or dry-laid processes.

The porous materials can be obtained from thermoplastic materials by film forming processes such as blow-molding or extrusion.

The powder composition of the present invention can be applied on the substrate as a single-layer or as a multi-layer coating. Preferably, it is applied on the substrate as a single-layer coating.

According to one embodiment the coating of the present invention is a uniform, and preferably odorless and/or flexible, film.

According to a preferred embodiment the coating layer has a thickness between 10 and 250 μm, more preferably between 20 and 150 μm, for example between 40 and 80 μm. Such thicknesses can be obtained for example by using electrostatic coating methods.

According to one embodiment the pulverized biopolymer powder composition has a particle size of 1 to 150 μm, preferably 5 to 150 μm, more preferably 10 to 120 μm, for example 20 to 100 μm. The particle size can be measured by a laser diffraction scattering method.

The biodegradable polyester used in the formation of the biopolymer of the powder composition of the present invention can be any biodegradable polyester. It can either be a commercial grade biopolyester or manufactured using well known polymerization routes. According to preferred embodiment, the biodegradable polyester is thermoplastic polyester, such as polybuthylene succinate, polyglycolic acid, polyhydroalkanoate, such as polyhydroxybutyrate or polyhydroxybutyrate valerate or polyhydroxybutyrate-co-hydroxyvalerate, polyaprolactone, polylactid acid, preferably polybuthylene succinate, preferably polybuthylene succinate.

One or more polyesters can be used in the present invention. For example, two different polyesters can be used in the formation of the biopolymer.

The siloxane precursor used can be a siloxane monomer, oligomer or polymer, or any mixture of these. The siloxane precursor can be modified or unmodified siloxane, for example triethoxysilane, tetraethoxysilane, ethoxytrimethylsilane, methyltriethoxysilane, hexyltrimethoxysilane, 1,2-bis(triethoxysilyl)ethane, 1,2-bis(dimethoxymethylsilyl)ethane, 1,2-bis(diethoxymethylsilyl)ethane, (3-glycidoxypropyl)trimethoxysilane, methyltrimethoxysilane, phenyltrimethoxysilane, phenylmethyldimethoxysilane, (3-aminopropyl)triethoxysilane, stearyl triethoxysilane, stearoxytrimethylsilane, polymethylsilsesquioxane, methacryloxypropyltrimethoxysilane, methacryloxypropyltriethoxysilane, methacryloyl propyltrimethoxysilane, polypropylsilsesquioxane, perfluorooctyl triethoxysilane, perfluorooctylethyl triethoxysilane, perfluorooctylethyl trimethoxysilane, polysilicone-22, polysilicone-27, polysilicone-7, silanetriol, sorbityl silanediol, or any mixture of these.

According to a preferred embodiment, the biopolymer of the powder composition is formed by the reaction product of polybuthylene succinate and siloxane oligomer.

According to one embodiment, the biopolymer formed by the reaction between the polyester and the siloxane precursor is a random polymer containing repeating siloxane units in a hydrocarbyl backbone. According to a further embodiment, the formed biopolymer comprises the polyester grafted with the siloxane precursor. The reaction product of polyester and the siloxane precursor typically has a number weight average molecular weight of 2000 to 1,500,000 g/mol, preferably 2500 to 50 000 g/mol, measured by a gel permeation chromatography (GPC). The molecular weight can be measured by the following method. Before the GPC measurement itself, the samples are dissolved overnight using chloroform (concentration of 1-5 mg/ml) and filtered (0.45 μm). Measurements are performed in chloroform eluent (0.6 ml/min, T=30° C.) using high-resolution water columns (Styragel HR 4 and 3) with a pre-column. The elution curves were detected using a refractive index detector (Waters 2414). The molar mass distributions (MMD) were calculated against 10× polystyrene (PS) (580-3 040 000 g/mol) standards, using a chromatography softwarer (Waters Empower 3 software).

The reaction product i.e. the biopolymer composition is pulverized to form a powder composition preferably containing hydrocarbyl residues and siloxane residues in a molar ratio in the range of 99:1 to 25:75, preferably 95:5 to 60:40.

According to one embodiment the powder composition comprises at least 50 weight-%, preferably 50 to 95 weight-%, more preferably 85 to 94 weight-%, for example 89 weight-%, polyester, calculated from the total weight of the powder composition.

According to one embodiment the molar fraction of the polyester is 10 to 80 mol-%, preferably 20 to 60 mol-%, for example 30 to 50 mol-%, of the powder composition.

According to one embodiment the powder composition comprises at least 0.1 weight-% siloxane, preferably at least 0.3 weight-% siloxane, for example 0.5-2.0 weight-% siloxane.

According to one embodiment the molar fraction of the siloxane is 5 to 90 mol-%, preferably 20 to 80 mol-%, for example 40 to 70 mol-%, of the powder composition.

According to a preferred embodiment the reaction product forming the biopolymer is formed by an esterification reaction between the polyester and the siloxane precursor.

According to another preferred embodiment the powder composition formed is biodegradable as a whole.

Polyol can be used as a plasticizer and to improve levelling, or as a catalyst, n the formation of the biopolymer composition. Polyol can be a monomeric, oligomeric or polymeric polyol comprising two or more hydroxyl groups, such as glycol, glycerol, pentaerythritol, sorbitol, xylitol, polyethylene oxide, polyethylene glycol, trimethylene glycol or polypropylene glycol, or any mixture of these. The polyol can be reacted with the siloxane precursor prior to reacting the siloxane with the polyester. According to another embodiment the polyol can be added to the reaction mixture of the polyester and the siloxane precursor, or the polyol can be present already in the polymerization reaction of the polyester after which the siloxane precursor is added thereto.

According to one embodiment the composition also comprises other additives that can be used to improve the properties and performance of the powder composition to be prepared. Additives, such as levelling aids or viscosity modifiers, or a combination of these, can for example be used to improve the film formation on a substrate. Additives may be added to the pulverized biopolymer using dry blending or, alternatively, they can be compounded into the biopolymer using melt compounding to manufacture biopolymer compounds with one or more additives. After the melt compounding, e.g. by extrusion or kneading, the prepared compound can be pulverized e.g. using cryogrinding or solvent preparation. The additives used may be for example oligomers, plasticisers, oils or levelling agents, or any mixtures thereof. Preferably, the additive is a polyether-modified polydimethylsiloxane, polyacrylate, polyethylene glycol or a combination thereof.

The composition may also comprise inorganic and/or organic filler, such as talc, geo, starch, wheat gluten or other natural polysaccharides, or wood derivatives, such as cellulose, lignin and their derivatives, or any combination thereof.

According to one embodiment the powder composition has a glass transition temperature, $T_g$, of between −50° C. and 79° C., preferably between −40° C. and 60° C. The melting temperature of the composition is equal or greater to about 80° C., preferably between 120 and 150° C.

The present invention also concerns a method for producing a packaging material by coating a porous substrate with the powder composition of the present invention comprising a biopolymer formed by the reaction product of biodegradable polyester and siloxane precursor. Preferably, the powder composition provides barrier properties for the packaging material.

According to one embodiment the coating provides barrier properties in a form of a water vapor transmission rate (WVTR) value of less than 300 g/($m^2$·24 h), preferably below 100 g/($m^2$·24 h), measured at 38° C., 90% RH.

The method of the present invention comprises providing a porous substrate, providing a polyester and providing a siloxane precursor, reacting the polyester with the siloxane precursor to form a biopolymer composition and pulverizing the biopolymer composition to form a powder. The powder is then applied on the porous substrate and cured to form a packaging material.

According to one embodiment the reaction between the polyester and the siloxane precursor occurs in a liquid state. According to one embodiment the liquid state is formed by a siloxane precursor solution, the polyester and a solvent. Preferably, the solvent is an organic solvent or a solvent mixture, such as ethanol or ethyl acetate or a mixture of those.

Siloxane precursor can be mixed with the polyester as such or it can be dissolved in a solvent, such as ethanol, prior to mixing. Especially if more than one siloxane precursors are used, a mixture of those is usually formed prior to reacting with the polyester. This can be done for example by mixing two or more siloxane precursors in a round bottom flask at room temperature for 0.5 to 2 hours, preferably for about 1 hour. Thus, according to one embodiment the siloxane precursor is obtained by mixing two or more siloxanes at room temperature. The formed siloxane precursor can be a siloxane oligomer or polymer.

The polyester can be made into a liquid state prior to mixing with the siloxane precursor or it can be made into a liquid state while being mixed with the siloxane precursor using a solvent in the reaction mixture, preferably an organic solvent or solvent mixture, such as ethyl acetate or acetone.

According to another embodiment, the polyester and the siloxane precursor can be mixed using a melt compounding, e.g. a twin screw extrusion. In melt compounding the polyester and the siloxane precursor are reacted with each other through reactive extrusion in a melt compounding process.

According to one embodiment, the siloxane precursor is mixed with the polyester in the presence of a solvent, and optionally a plasticizer, or a catalyst, and an additive.

According to another embodiment, a siloxane precursor solution is formed by dissolving one or more siloxane precursors in a solvent prior to mixing with the polyester.

According to a further embodiment, the siloxane precursor solution is reacted with a plasticizer or catalyst, preferably a polyol, prior to mixing with the polyester. This can be done for example under nitrogen atmosphere at temperature of 120 to 200° C., preferably at about 160° C., by using a reflux condenser for about one to two hours. After the heating, the mixture is cooled to room temperature.

According to another embodiment the plasticizer or catalyst can be added to the reaction mixture of the polyester and the siloxane precursor. Thus, according to one embodiment, the polyester and the siloxane are reacted in the presence of plasticizer or catalyst which is preferably a monomeric or polymeric polyol comprising two or more hydroxyl groups.

Heating is required to obtain the reaction between the polyester and the polysiloxane precursor. According to one embodiment the polyester and the siloxane precursor are reacted at elevated temperature of at least 60° C., preferably at 60 to 150° C., more preferably at 60 to 100° C. Usually, the mixing is done under nitrogen atmosphere using a reflux condenser for about 15 minutes to an hour, preferably for about 30 minutes. The polyester and the siloxane precursor can also be reacted under air or any protective atmosphere. After the reaction is occurred, the formed biopolymer composition is cooled to room temperature.

According to one embodiment, the possible solvent used in the reaction mixture can be removed after the reaction between the polyester and the siloxane has occurred. This is preferably done by solvent evaporation. Thus, according to a preferred embodiment the powder coating composition is essentially solvent-free, i.e. the composition comprises not more than 0.5 weight-%, preferably not more than 0.1 weight-%, most preferably the 0 weight-%, of solvent.

To obtain a powder composition, the biopolymer composition is typically pulverized. The pulverization can be performed by any known pulverization method, such as by a crushing, impacting, grinding, or solvent precipitation method.

According to one embodiment the pulverization is done by cryogrinding. Liquid nitrogen or liquid carbon dioxide can be used to generate the cryogenic conditions for the grinding. Since the biopolymer composition to be pulverized typically has a glass transition temperature ($T_g$) below 100° C., precooling of the polymer granules prior cryogrinding is preferably done by placing the granules for example in liquid nitrogen prior grinding. The cryogenic mill used may be impact mill type having an adjustable feeding screw allowing also feeding of the cooling medium to the mill. During grinding the feeding of the cooling medium is controlled so, that the temperatures inside the mill stay below the glass transition temperature of the grinded biopolymer.

In one embodiment, the particle size of the pulverized biopolymer composition is between to 120 μm, measured by laser diffraction scattering method.

According to another embodiment the pulverization is done by a solvent precipitation method. Such an embodiment can be carried out by first dissolving the biopolymer into a solvent, such as acetone, ethyl acetate, isoamyl alcohol, toluene or chloroform, to form a solution containing typically about 1 to about 50%, in particular 5 to 40% by weight of the biopolymer. Dissolution is typically carried out at a temperature in the range of from 50 to 150° C. Dissolution is typically carried out by mixing and preferably using a reflux condenser. After the biopolymer is dissolved, precipitation of the biopolymer from the solvent is done by cooling the suspension to room temperature under continuous agitation. When the polymer is precipitated, solvent is removed by solvent evaporation. To obtain very fine powders, further milling with nitrogen cooling can be used to produce even finer particle size distributions. Particles sizes between 10 to 120 μm can be achieved, the particle size being measure by laser diffraction scattering.

The powder composition can be applied on a substrate for example by using electrostatic spray coating methods. These include the use of triboelectric charging spray guns, corona charging spray guns, electromagnetic brush (EMB) technology, or fluidized beds, preferably electrostatic spray gun. However, other coating methods are also applicable.

The electrostatic spray coating method comprises projecting charged biopolymer powder particles towards a conductive substrate by an electrostatic charge. In the present method the distance between the spray gun and the substrate is preferably from 10 to 100 cm, preferably from 30 to 80 cm, for example about 50 cm.

After the powder composition is applied on the substrate, the composition needs to be cured in order to form a uniform and even coating layer. Once exposed to an elevated temperature the powder composition starts to melt and then preferably chemically reacts to form a higher molecular weight polymer in a network structure, for example by crosslinking. According to a preferred embodiment this step, which can also be referred to as "curing" is performed at elevated temperature of 100 to 250° C., preferably at about 120 to 170° C. or 180° C., for example at 150° C. The curing time is typically between 1 to 120 minutes, for example 5 to 20 minutes, preferably about 10 minutes.

According to one embodiment the arithmetic mean surface roughness value (Ra) of the coating according to the invention is below 20 μm, preferably below 5 μm, measured with an optical profilometer.

The packaging material according to the invention or produced by the method of the invention can be a packaging material or even a ready package as such. According to another embodiment it can be any part of another packaging material or package. It can be for example a blank, a sheet or an article.

It is to be understood that the embodiments of the invention disclosed are not limited to the particular structures, process steps, or materials disclosed herein, but are extended to equivalents thereof as would be recognized by those ordinarily skilled in the relevant arts.

It should also be understood that terminology employed herein is used for the purpose of describing particular embodiments only and is not intended to be limiting.

Reference throughout this specification to one embodiment or an embodiment means that a particular feature, structure, or characteristic described in connection with the embodiment is included in at least one embodiment of the present invention. Thus, appearances of the phrases "in one embodiment" or "in an embodiment" in various places throughout this specification are not necessarily all referring to the same embodiment. Where reference is made to a numerical value using a term such as, for example, about or substantially, the exact numerical value is also disclosed.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary. In addition, various embodiments and examples of the present invention may be referred to herein along with alternatives for the various components thereof. It is understood that such embodiments, examples, and alternatives are not to be construed as de facto equivalents of one another, but are to be considered as separate and autonomous representations of the present invention.

Furthermore, the described features, structures, or characteristics may be combined in any suitable manner in one or more embodiments. In this description, numerous specific details are provided, such as examples of lengths, widths, shapes, etc., to provide a thorough understanding of embodiments of the invention. One skilled in the relevant art will recognize, however, that the invention can be practiced without one or more of the specific details, or with other methods, components, materials, etc.

While the forgoing examples are illustrative of the principles of the present invention in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the invention be limited, except as by the claims set forth below.

In particular, it should be understood that, although, the present application especially describes the biopolymer formed by the reaction product of biodegradable polyester and siloxane precursor, also other metalloxane precursors can be used instead of siloxane or in combination therewith.

According to one embodiment the metalloxane precursor can be selected from the group of siloxane, germanoxane, aluminoxane, titanoxane, zirconoxane, ferroxane and stannoxane precursors and combinations thereof. In particular, the metalloxane precursors can be selected from the group of metalloxane monomer, oligomers and polymers and combinations thereof, for example siloxane monomer, oligomers and polymers and combinations thereof.

The following non-limiting examples are intended merely to illustrate the advantages obtained with the embodiments of the present invention.

EXAMPLES

Example 1

Mixture 1—Preparation of Siloxane Precursor Solution 25 g (0.1058 mol) of 1,2-bis(triethoxysilyl)ethane, 25 g (0.0705 mol) of (3-glycidoxypropyl) trimethoxysilane, 50 g of ethanol and 5 g of water were mixed in a round bottom flask equipped with a magnetic stirrer. The solution was mixed for 1 hour at room temperature.

Preparation of biopolymer powder composition 23.4 g of commercial grade polybutylene succinate, 2.6 g of polyethylene glycol having an average molecular weight of 400 g/mol ($M_n$), 2.6 g of Mixture 1 (Example 1), and 0.26 g of BYK333 (polyether-modified polydimethylsiloxane) as additive and 75 g of technical grade ethyl acetate was weighed into a 500 ml round bottom flask. The mixture was heated to 78° C. using reflux condenser and mixing under nitrogen atmosphere for 30 minutes. Then the formed biopolymer suspension was cooled to room temperature and the solvent was removed using solvent evaporation. After removal of the solvent, the obtained powder was sieved to median particle size between 30 and 70 μm.

Coating of the Substrate

The powder composition was used in powder coating of a cardboard substrate using electrostatic charging. The coating was applied using electrostatic spray gun on the charged substrate using 50 cm distance. Next, the substrate coated with the powder composition was heated in an air convection oven at 150° C. for 10 minutes to form an even coating layer on the substrate.

Example 2

Mixture 1—Preparation of Siloxane Precursor Solution 50 g (0.141 mol) of 1,2-bis(triethoxysilyl)ethane, 100 g of ethanol and 5 g of water were mixed in a round bottom flask equipped with a magnetic stirrer. Solution was mixed for 1 hour at room temperature.

Mixture 2—Reacting Siloxane Precursor with Polyol 60 g (0.150 mol) of polyethylene glycol having an average molecular weight of 400 g/mol ($M_n$), 17.7 g (0.150 mol) of bio-succinic acid and 23.31 g of Mixture 1 (Example 2) were weighed into 500 ml round bottom flask. The mixture was heated to 160° C. using reflux condenser and mixing under nitrogen atmosphere for 1 hour 45 minutes. Then the mixture was cooled to room temperature.

Preparation of Biopolymer Powder Composition 17.3 g of commercial grade polybutylene succinate and 2.7 grams of Mixture 2 (Example 2) as additive and 50 g of technical grade ethyl acetate was weighed into a 500 ml round bottom flask. The mixture was heated to 78° C. using reflux condenser and mixing under nitrogen atmosphere for 30 minutes. Then the formed biopolymer suspension was cooled to room temperature and the solvent was removed using solvent evaporation. After removal of the solvent, the obtained powder was sieved to median particle size between 30 and 70 μm.

Coating of the Substrate

The powder composition was used in powder coating of a cardboard substrate using electrostatic charging. The coating was applied using electrostatic spray gun on the charged substrate using 50 cm distance. Next, the substrate coated with the powder composition was heated in an air convection oven at 150° C. for 10 minutes to form an even coating layer on the substrate.

Example 3

Preparation of Biopolymer Powder Composition 18 g of commercial grade polybutylene succinate and 0.16 g of BYK333 (polyether-modified polydimethylsiloxane) as additive and 50 g of technical grade ethyl acetate was weighed into a 500 ml round bottom flask. The mixture was heated to 78° C. using reflux condenser and mixing under nitrogen atmosphere for 30 minutes. Then the biopolymer suspension was cooled to room temperature and the solvent was removed using solvent evaporation. After removal of the solvent, the obtained powder composition was sieved to median particle size between 30 and 70 μm.

Coating of the Substrate

The powder composition was used in powder coating of a cardboard substrate using electrostatic charging. The coating was applied using electrostatic spray gun on the charged substrate using 50 cm distance. Next, the substrate coated with a powder composition was heated in an air convection oven at 150° C. for 10 minutes to form an even coating layer on the substrate.

Example 4

Preparation of Biopolymer Powder Composition 18 g of commercial grade polybutylene succinate, 2 g of polyethylene glycol having average molecular weight of 400 g/mol ($M_n$) and 0.2 grams of BYK333 (polyether-modified polydimethylsiloxane) as additive and 50 g of technical grade ethyl acetate was weighed into a 500 ml round bottom flask. The mixture was heated to 78° C. using reflux condenser and mixing under nitrogen atmosphere for 30 minutes. Then the biopolymer suspension was cooled to room temperature and the solvent was removed using solvent evaporation. After removal of the solvent, the obtained powder was sieved to median particle size between 30 and 70 μm.

Coating of the Substrate

The powder composition was used in powder coating of a cardboard substrate using electrostatic charging. The coating was applied using electrostatic spray gun on the charged substrate using 50 cm distance. Next, the substrate coated with the powder composition was heated in an air convection oven at 150° C. for 10 minutes to form an even coating layer on the substrate.

Example 5

Polyester Synthesis

Poly(butylene succinate) was synthetized using 1,4-butanediol (BDO) and succinic acid (SA) in molar ratios of 1.1:1. Firstly, esterification of SA and BDO was conducted in a temperature of 160 to 190° C. under nitrogen atmosphere while removing water and/or methanol from the reaction mixture. When no more water/methanol could be removed using atmospheric pressure, the polycondensation reaction was started in the presence of a organometallic catalyst, namely stannous octoate, at a temperature of 200 to 240° C. under vacuum for 4 to 6 hours. After obtaining desired viscosity of the polymer, it was collected from the reaction vessel and pelletized.

Preparation of Biopolymer Powder Composition 18 g of prepared polybutylene succinate and 0.16 g of BYK333 (polyether-modified polydimethylsiloxane) as additive and 50 g of technical grade ethyl acetate was weighed into a 500 ml round bottom flask. The mixture was heated to 78° C. using reflux condenser and mixing under nitrogen atmosphere for 30 minutes. Then the biopolymer suspension was cooled to room temperature and the solvent was removed using solvent evaporation. After removal of the solvent, the obtained powder was sieved to median particle size between 30 and 70 μm.

Coating of the Substrate

The powder composition was used in powder coating of a cardboard substrate using electrostatic charging. The coating was applied using electrostatic spray gun on the charged substrate using 50 cm distance. Next, the substrate coated with the powder composition was heated in an air convection oven at 150° C. for 10 minutes to form an even coating layer on the substrate.

Example 6

Barrier properties of the compositions presented in the above examples were investigated by an overnight liquid absorption test and the results were compared to a substrate without any coating. The substrate used in the test was a cardboard. Oil, ethanol and water were used as absorbents. The results of the measurements are presented in Table 1.

Table 1. Oil, ethanol and water overnight liquid absorption test results for different powder coating compositions on a cardboard substrate compared to substrate without any coating. No=no absorption and/or penetration to the substrate, yes=absorbed through the coating to the substrate.

| Coating | Coating thickness (μm) | Oil | Ethanol | Colored DI-water |
|---|---|---|---|---|
| No coating | 0.00 | Yes | Yes | Yes |
| Example 3 | 0.18 | No | No | No |
| Example 4 | 0.25 | No | No | No* |

*some colouring on the coating layer, not on substrate.

Example 7

Preparation of PLA

L-lactic acid (1000 g, 11.10 mol) were weighed into a round bottom flask and stirred at 175° C. for 4 hours. Then 0.1 wt-% of solid tin oxide catalyst was added and the temperature was raised to 230° C. L-lactide formed was separated from the mixture by vacuum of 5 mbar. Prepared L-lactide was heated in a round bottom flask at 170° C. on oil bath. Then 0.1 wt-% of tin octoate catalyst was added and the reaction was continued from 15 minutes to 4 hours until molecular weight of 180 000 g/mol was reached.

Preparation of Biopolymer Powder Composition 900 g of previously prepared polylactic acid (PLA) was melt compounded using twin-screw extrusion with 100 g of polyethylene glycol having average molecular weight of 400 g/mol ($M_n$) and 10 g of BYK333 at 180° C. extrusion temperature and 150 rpm screw speed. The compounded material was extruded into strands and pelletized into granules.

Powder Preparation

The biopolymer powder was manufactured using cryogenic grinding. Prior grinding, the compounded biopolymer granules were first precooled using liquid nitrogen. The precooled biopolymer granules were then grinded into a powder using and impact type cryogenic mill. Liquid nitrogen was used as cooling medium in the cryogenic grinding and it was continuously fed to keep temperatures inside the mill below 0° C. Rotational speed used in the milling was 15 000 rpm and the speed of the materials dosing screw was 20 rpm. 90 μm screen plate was used to obtain finely ground powder for powder coating. The obtained biopolymer powder was dried in vacuum oven before used as coating material.

Coating of the Substrate

The powder composition was used in powder coating of a cardboard substrate using electrostatic charging. The coating was applied using electrostatic spray gun on the charged substrate using 50 cm distance. Next, the substrate coated with the powder composition was heated in an air convection oven at 180° C. for 10 minutes to form an even coating layer on the substrate.

Example 8

Preparation of Biopolymer Powder Composition 23 g of commercial grade poly(lactic acid), 2.6 g of trimethylene glycol having an average molecular weight between 900-1100 g/mol ($M_n$), 2.6 g of Mixture 1 (Example 1), and 0.26 g of BYK359 as additive and 100 g of technical grade acetone was weighed into a 500 ml round bottom flask. The mixture was heated to 55° C. using reflux condenser and mixing under nitrogen atmosphere for 60 minutes. Then the formed biopolymer suspension was cooled to room temperature and the solvent was removed using solvent evaporation. After removal of the solvent, the obtained powder was sieved to median particle size between 30 and 70 μm.

Coating of the Substrate

The powder composition was used in powder coating of a cardboard substrate using electrostatic charging. The coating was applied using electrostatic spray gun on the charged substrate using 50 cm distance. Next, the substrate coated with the powder composition was heated in an air convection oven at 180° C. for 10 minutes to form an even coating layer on the substrate.

Example 9

Preparation of Biopolymer Powder Composition 45 g of commercial grade polybutylene succinate, 5.0 g of trimethylene glycol having an average molecular weight between 900-1100 g/mol ($M_n$), 0.5 g of BYK333 (polyether-modified polydimethylsiloxane) as additive and 100 g of technical grade ethyl acetate was weighed into a 500 ml round bottom flask. The mixture was heated to 78° C. using reflux condenser and mixing under nitrogen atmosphere for 30 minutes. Then the biopolymer suspension was cooled to room temperature and the solvent was removed using solvent evaporation. After removal of the solvent, the obtained powder composition was sieved to particle size below 100 μm.

Coating of the Substrate

The powder composition was used in powder coating of a cardboard substrate using electrostatic charging. The coating was applied using electrostatic spray gun on the charged substrate using 50 cm distance. Next, the substrate coated with a powder composition was heated in an air convection oven at 150° C. for 10 minutes to form an even coating layer on the substrate.

Example 10

Mixture 1—Preparation of Siloxane Precursor Solution 50 g (0.201 mol) of methacryloxypropyltrimethoxysilane, 100 g of isopropanol and 2.1 g of 0.1M acetic acid were mixed in a round bottom flask equipped with a magnetic stirrer. Solution was mixed for 1 hour at room temperature.

Mixture 2—Reacting the Siloxane Precursor with Polyol 60 g (0.150 mol) of polyethylene glycol having an average molecular weight of 400 g/mol ($M_n$), 17.7 g (0.150 mol) of bio-succinic acid and 23.31 g of Mixture 1 (Example 10) were weighed into 500 ml round bottom flask. The mixture was heated to 160° C. using reflux condenser and mixing under nitrogen atmosphere for 1 hour 45 minutes. Then the mixture was cooled to room temperature.

Preparation of Biopolymer Powder Composition 17.3 g of commercial grade polybutylene succinate and 2.7 grams of Mixture 2 (Example 10) as additive and 50 g of technical grade ethyl acetate was weighed into a 500 ml round bottom flask. The mixture was heated to 78° C. using reflux condenser and mixing under nitrogen atmosphere for 30 minutes. Then the formed biopolymer suspension was cooled to room temperature and the solvent was removed using solvent evaporation. After removal of the solvent, the obtained powder was sieved to median particle size between 30 and 70 μm.

Coating of the Substrate

The powder composition was used in powder coating of a cardboard substrate using electrostatic charging. The coating was applied using electrostatic spray gun on the charged substrate using 50 cm distance. Next, the substrate coated with the powder composition was heated in an air convection oven at 150° C. for 10 minutes to form an even coating layer on the substrate.

Example 11

Preparation of PLA

L-lactic acid (1000 g, 11.10 mol) were weighed into a round bottom flask and stirred at 175° C. for 4 hours. Then 0.1 wt-% of solid tin oxide catalyst was added and the temperature was raised to 230° C. L-lactide formed was separated from the mixture by vacuum of 5 mbar. Prepared L-lactide was heated in a round bottom flask at 170° C. on oil bath. Then 0.1 wt.-% of tin octoate catalyst was added and the reaction was continued from 15 minutes to 4 hours until molecular weight of 180 000 g/mol was reached.

Preparation of Biopolymer Powder Composition 900 g of previously prepared polylactic acid (PLA) was melt compounded using twin-screw extrusion with 100 g of polyethylene glycol having average molecular weight of 400 g/mol ($M_n$) and 10 g of BYK332 at 180° C. extrusion temperature and 150 rpm screw speed. The compounded material was extruded into strands and pelletized into granules.

Powder Preparation

The biopolymer powder was manufactured using cryogenic grinding. Prior grinding, the compounded biopolymer granules were first precooled using liquid nitrogen. The precooled biopolymer granules were then grinded into a powder using and impact type cryogenic mill. Liquid nitrogen was used as cooling medium in the cryogenic grinding and it was continuously fed to keep temperatures inside the mill below 0° C. Rotational speed used in the milling was 15 000 rpm and the speed of the materials dosing screw was 20 rpm. 90 μm screen plate was used to obtain finely ground powder for powder coating. The obtained biopolymer powder was dried in vacuum oven before used as coating material.

Coating of the Substrate

The powder composition was used in powder coating of a cardboard substrate using electrostatic charging. The coating was applied using electrostatic spray gun on the charged substrate using 50 cm distance. Next, the substrate coated with the powder composition was heated in an air convection oven at 200° C. for 10 minutes to form an even coating layer on the substrate.

Example 12

Preparation of Biopolymer Powder Composition 980 g of commercial grade polybutylene succinate, 980 g of commercial grade poly(3-hydroxybutyrate-co-3-hydroxyvalerate), 20 g of Mixture 1 (Example 1) and 20 g of BYK360P (polyacrylate) were mixed and melt compounded into granules in a twin screw extruder at 170° C. using 100 rpm screw speed.

Powder Preparation

The biopolymer powder was manufactured using cryogenic grinding. Prior grinding, the compounded biopolymer granules were first precooled using liquid nitrogen. The precooled biopolymer granules were then grinded into a powder using and impact type cryogenic mill. Liquid nitrogen was used as cooling medium in the cryogenic grinding and it was continuously fed to keep temperatures inside the mill below 0° C. Rotational speed used in the milling was 15 000 rpm and the speed of the materials dosing screw was 20 rpm. 90 μm screen plate was used to obtain finely ground powder for powder coating. The obtained biopolymer powder was dried in vacuum oven before used as coating material.

Coating of the Substrate

The powder composition was used in powder coating of a cardboard substrate using electrostatic charging. The coating was applied using electrostatic spray gun on the charged substrate using 50 cm distance. Next, the substrate coated with the powder composition was heated in an air convection oven at 170° C. for 10 minutes to form an even coating layer on the substrate.

Example 13

Preparation of Biopolymer Powder Composition 15 g of commercial grade polylactic acid, 32 g of commercial grade polybutylene succinate, 2.5 g of polyethylene glycol having average molecular weight of 200 g/mol ($M_n$) and 0.5 g of commercial polyether-modified polydimethylsiloxane (BYK332) and 50 g of technical grade acetone was weighed into a 500 ml round bottom flask. The mixture was heated to 55° C. using reflux condenser and mixing under nitrogen atmosphere for 30 minutes. Then the formed biopolymer suspension was cooled to room temperature and the solvent was removed using solvent evaporation. After removal of the solvent, the obtained powder was sieved to median particle size between 30 and 70 μm.

Coating of the Substrate

The powder composition was used in powder coating of a cardboard substrate using electrostatic charging. The coating was applied using electrostatic spray gun on the charged substrate using 50 cm distance. Next, the substrate coated with the powder composition was heated in an air convection oven at 180° C. for 10 minutes to form an even coating layer on the substrate.

Example 14

Surface Modification of Talc 30 g of talc powder (median particle size 1 μm) was mixed with 200 g of ethanol and 10 g of 3-aminopropyltriethoxysilane and mixed 3 h in room temperature under magnetic stirring. Talc was filtered from the solution, washed with 200 ml of ethanol and with 500 ml of deionized water, then dried in an air convection oven at 60° C. overnight.

Preparation of Biopolymer Powder Composition 490 g of commercial grade polylactic acid, 480 g of commercial grade polybutylene succinate, 20 g of surface modified talc and 10 g of commercial polyether-modified polydimethylsiloxane (BYK307) was melt compounded in a twin screw extruder at 190° C. using 100 rpm screw speed. Then, 25 grams of the melt compounded biopolymer composition and 100 g of technical grade acetone was weighed into a 500 ml round bottom flask and heated to 55° C. using reflux condenser and mixed under nitrogen atmosphere for 30 minutes. Then the formed biopolymer suspension was cooled to room temperature and the solvent was removed using solvent evaporation. After removal of the solvent, the obtained powder was sieved to median particle size between 30 and 70 μm.

Coating of the Substrate

The powder composition was used in powder coating of a cardboard substrate using electrostatic charging. The coating was applied using electrostatic spray gun on the charged substrate using 50 cm distance. Next, the substrate coated with the powder composition was heated in an air convection oven at 180° C. for 10 minutes to form an even coating layer on the substrate.

Example 15

Mixture 1—Preparation of Siloxane Precursor Solution 22.3 g of aqueous biosuccinic acid solution (1.3 wt.-% of biosuccinic acid diluted in deionized water) was gradually added to 191.7 g of methyltriethoxysilane. The solution was mixed 12 hours at room temperature prior to use.

Preparation of biopolymer powder composition 470 g of commercial grade polybutylene succinate, 25 g of polyethylene glycol having average molecular weight of 200 g/mol ($M_n$) and 5 g of Mixture 1 (Example 15) was melt compounded using twin screw extrusion at 140° C. using 100 rpm screw speed. 50 g of the compounded biopolymer composition and 100 g of technical grade ethyl acetate was weighed into a 500 ml round bottom flask. The mixture was heated to 78° C. using reflux condenser and mixing under nitrogen atmosphere for 30 minutes. Then the formed biopolymer suspension was cooled to room temperature and the solvent was removed using solvent evaporation. After removal of the solvent, the obtained powder was sieved to median particle size between 30 and 70 μm.

Coating of the Substrate

The powder composition was used in powder coating of a cardboard substrate using electrostatic charging. The coating was applied using electrostatic spray gun on the charged substrate using 50 cm distance. Next, the substrate coated with the powder composition was heated in an air convection oven at 160° C. for 10 minutes to form an even coating layer on the substrate.

Example 16

Mixture 1—Preparation of Siloxane Precursor Solution 40 g (0.29 mol) of methyltrimethoxysilane, 80 g of ethanol and 5 g of water were mixed in a round bottom flask equipped with a magnetic stirrer. Solution was mixed for 1 hour at room temperature.

Preparation of Biopolymer Powder Composition 23 g of commercial grade polylactic acid, 2.6 g of trimethylene glycol having an average molecular weight between 900-1100 g/mol ($M_n$), 2.6 g of Mixture 1 (Example 16) and 100 g of technical grade acetone was weighed into a 500 ml round bottom flask. The mixture was heated to 55° C. using reflux condenser and mixing under nitrogen atmosphere for 90 minutes. Then the formed biopolymer suspension was cooled to room temperature and the solvent was removed using solvent evaporation. After removal of the solvent, the obtained powder was sieved to median particle size between 30 and 70 μm.

Coating of the Substrate

The powder composition was used in powder coating of a cardboard substrate using electrostatic charging. The coating was applied using electrostatic spray gun on the charged substrate using 50 cm distance. Next, the substrate coated with the powder composition was heated in an air convection oven at 180° C. for 10 minutes to form an even coating layer on the substrate.

Example 17

Barrier properties of the compositions presented in the above examples were investigated by an overnight liquid absorption test and the results were compared to a substrate without any coating as well as PBS and PLA powders. The reference materials were made into powder form using the solvent method described in the previous examples. PBS reference was prepared using ethyl acetate, 78° C. temperature and reflux condenser, PLA reference was prepared using acetone, 55° C. temperature and reflux condenser. The biopolymer suspensions were cooled to room temperature and made into powder form by removal of the solvent by evaporation.

The substrate used in the test was a cardboard. Oil, ethanol (50% ethanol:water mixture), and water with blue dye were used as absorbents. The results of the measurements are presented in Table 1.

Table 1. Oil, ethanol, and water overnight liquid absorption test results for different powder coating compositions on a cardboard substrate compared to substrate without any coating. No=no absorption and/or penetration to the substrate, yes=absorbed through the coating to the substrate.

| Coating | Coating thickness (mm) | Coating quality | Oil | Ethanol | Colored DI-water |
|---|---|---|---|---|---|
| No coating | 0.00 | — | Yes | Yes | Yes |
| PBS | 0.15 | Poor | Yes | No | No* |
| PLA | 0.12 | Poor | Yes | No | No |
| Example 3 | 0.18 | even | No | No | No* |
| Example 4 | 0.25 | even | No | No | No* |

-continued

| Coating | Coating thickness (mm) | Coating quality | Oil | Ethanol | Colored DI-water |
|---|---|---|---|---|---|
| Example 9 | 0.11 | even | No | No | No |
| Example 15 | 0.12 | even | No | No | No |

*some colouring on the coating layer, not on substrate.

The results in Table 1 show that the powder coating compositions according to the present invention have better coating quality and barrier properties compared to the uncoated substrate as well as the reference PBS and PLA materials. The improved barrier properties of the powder coatings can be related to the combination of biopolyester and siloxane precursors in the material compositions according to the invention. Also, the levelling and smoothness of the coatings according to the invention were clearly improved in comparison with the reference materials.

In addition, the powder coating compositions according to the present invention have better oil resistance compared to the substrate without any coating as well as the reference PBS and PLA materials. The poor oil resistance of the reference PBS and PLA is also due to the poor coating quality of the materials.

The ethanol and water resistance of the coating compositions according to the present invention in comparison with the uncoated substrate were also greatly improved. There was no signs of absorption of ethanol or water in the substrate.

INDUSTRIAL APPLICABILITY

The present invention can be used to produce packaging materials having a biopolymer coating, and generally for replacement of conventional methods of producing packaging materials.

In particular, the powder coating composition of the present in invention is useful in packaging materials of foodstuff, cosmetics and pharmaceuticals. Especially, the invention enables a single layer coating on a porous substrates.

CITATION LIST

Patent Literature

U.S. Pat. No. 6,274,672
U.S. Pat. No. 5,227,435

The invention claimed is:

1. A packaging material comprising a coated porous substrate, wherein the coated porous substrate comprises a porous substrate and a coating on the porous substrate, the coating comprising a curedQ layer comprising a biopolymer formed by a reaction product of a biodegradable polyester and a metalloxane precursor, and wherein the reaction product forming the biopolymer is formed by an esterification reaction between the biodegradable polyester and the metalloxane precursor.

2. The packaging material according to claim 1, wherein the coated porous substrate comprises a single-layer coating of the coating.

3. The packaging material according to claim 1, wherein the coating provides barrier properties for the packaging material selected from the group consisting of a liquid barrier, gas barrier, oil barrier, grease barrier, and combinations thereof.

4. The packaging material according to claim 1, wherein the coating has an arithmetic mean surface roughness value (Ra) below 20 μm, measured with an optical profilometer.

5. The packaging material according to claim 1, wherein the metalloxane precursor comprises a siloxane precursor selected from the group consisting of a siloxane monomer, oligomer and polymer, and combinations thereof, and wherein the biodegradable polyester comprises a thermoplastic biopolymer selected from the group consisting of polybuthylene succinate, polyglycolic acid, a polyhydroalkanoate,-, polycaprolactone, polylactid acid, polybutylene adipate terephthalate, and polybuthylene succinate.

6. The packaging material according to claim 1, wherein the metalloxane precursor is reacted with a monomeric or polymeric polyol comprising two or more hydroxyl groups, prior to mixing with the biodegradable polyester.

7. The packaging material according to claim 1, wherein the formed biopolymer is a random polymer containing repeating siloxane units in a hydrocarbyl backbone, and wherein the biopolymer comprises polyester that is grafted with siloxane precursor.

8. The packaging material according to claim 1, wherein the reaction product has a number average molecular weight of 2,000 to 1,500,000 g/mol.

9. The packaging material according to claim 1, wherein the coating is obtained by melting and curing a powder coating composition comprising the biopolymer onto a surface of the porous substrate.

10. The packaging material according to claim 9, wherein the powder composition has an average particle size of 5 to 150 μm.

11. The packaging material according to claim 9, wherein the powder composition comprises at least 50 weight-% of the biodegradable polyester, and wherein the powder composition contains hydrocarbyl residues and siloxane residues at a molar ratio in the range of 99:1 to 50:50.

12. The packaging material according to claim 9, wherein the powder composition has a glass transition temperature, $T_g$, between −50° C. and 79° C.

13. The packaging material according to claim 9, wherein the powder composition further comprises inorganic and/or organic fillers selected from the group consisting of talc, geopolymer, starch, wheat gluten, natural polysaccharides, wood derivatives, cellulose, lignin and their derivatives, and combinations thereof.

14. The packaging material according to claim 1, wherein the substrate comprises paper, cardboard, or plastic.

15. A method for producing a packaging material comprising the steps of providing a porous substrate,
providing a biodegradable polyester,
providing a metalloxane precursor,
reacting the biodegradable polyester with the metalloxane precursor in an esterification
reaction to form a biopolymer composition,
pulverizing the biopolymer composition to form a powder,
applying the powder on the porous substrate, and
curing the applied powder to form a packaging material.

16. The method according to claim 15, wherein the metalloxane precursor comprises a siloxane precursor, and wherein the siloxane precursor is obtained by mixing two or more siloxanes at room temperature, and wherein optionally
a solvent is removed from the biopolymer composition prior to pulverization, and/or wherein the biodegradable polyester and the siloxane precursor are reacted under nitrogen, air or any protective atmosphere at elevated temperature of at least 60° C.

17. The method according to claim 16, wherein the biodegradable polyester and the metalloxane precursor are reacted in the presence of a monomeric, oligomeric or polymeric polyol comprising two or more hydroxyl groups.

18. The method according to claim 15, wherein the biopolymer composition is pulverized to form a powder having an average particle size of 1 to 150 μm, and wherein the pulverizing is done by grinding, cryogenic grinding, or solvent precipitation method, and wherein the powder is applied to the porous substrate using electrostatic spray coating after which the curing is performed at an elevated temperature of 100 to 250° C.

19. The method according to claim 15, wherein the biodegradable polyester and the metalloxane precursor are mixed using a melt compounding.

20. A packaging material comprising a porous substrate, wherein the porous substrate comprises a coating, the coating comprising a cured layer of a powder composition comprising a biopolymer formed by a reaction product of a biodegradable polyester and a metalloxane precursor, wherein the metalloxane precursor comprises a siloxane precursor, and wherein the molar fraction of the siloxane precursor is 20 to 90 mol-% of the powder composition.

* * * * *